US012111144B2

(12) United States Patent
Lee

(10) Patent No.: US 12,111,144 B2
(45) Date of Patent: Oct. 8, 2024

(54) ELECTRONIC SELF-DESTRUCTING FUSE STRUCTURE

(71) Applicant: Seju Engineering Co., Ltd., Daejeon (KR)

(72) Inventor: Won-Bae Lee, Daejeon (KR)

(73) Assignee: SEJU ENGINEERING CO., LTD., Daejeon (KR)

( * ) Notice: Subject to any disclaimer, the term of this patent is extended or adjusted under 35 U.S.C. 154(b) by 5 days.

(21) Appl. No.: 17/770,002

(22) PCT Filed: Oct. 15, 2020

(86) PCT No.: PCT/KR2020/014064
§ 371 (c)(1),
(2) Date: Apr. 18, 2022

(87) PCT Pub. No.: WO2021/080242
PCT Pub. Date: Apr. 29, 2021

(65) Prior Publication Data

US 2022/0390217 A1 Dec. 8, 2022

(30) Foreign Application Priority Data

Oct. 22, 2019 (KR) ..... 10-2019-0131287

(51) Int. Cl.
*F42C 9/16* (2006.01)

(52) U.S. Cl.
CPC ..... *F42C 9/16* (2013.01)

(58) Field of Classification Search
CPC .. F42C 9/14; F42C 9/141; F42C 9/147; F42C 9/16
USPC ..... 102/238
See application file for complete search history.

(56) References Cited

U.S. PATENT DOCUMENTS 6,142,080 A * 11/2000 Ziemba ..... F42C 9/18 102/500
2011/0036258 A1 2/2011 Taylor
2012/0216698 A1* 8/2012 Van Stratum ..... F42B 30/04 102/439

(Continued)

FOREIGN PATENT DOCUMENTS

EP 0 605 356 A1 7/1994
KR 100915706 B1 9/2009
KR 10-1016834 B1 2/2011

(Continued)

OTHER PUBLICATIONS

International Search Report and Written Opinion of PCT/KR2020/014064.

(Continued)

*Primary Examiner* — Bret Hayes
(74) *Attorney, Agent, or Firm* — Maschoff Brennan

(57) ABSTRACT

The present invention relates to an electronic self-destructing fuse structure which releases a safety device by means of a predetermined level of setback and centrifugal force after a 40 mm grenade is launched, thereby ensuring safety, and which can explode according to the application of an impact of a predetermined level or higher, and also self-destruct after a predetermined time elapses if the impact does not reach the predetermined level and an explosion does not occur, thereby preventing the occurrence of an unexploded grenade.

12 Claims, 8 Drawing Sheets

(56) References Cited

U.S. PATENT DOCUMENTS

2022/0390217 A1 12/2022 Lee

FOREIGN PATENT DOCUMENTS

| | | | |
|---|---|---|---|
| KR | 101078153 | B1 | 10/2011 |
| KR | 1020110128071 | A | 11/2011 |
| KR | 101317713 | B1 | 11/2013 |
| KR | 1020160073228 | A | 6/2016 |
| KR | 10-2021-0067876 | A | 6/2021 |

OTHER PUBLICATIONS

Office Action received in Korean Patent Application No. 10-2020-0135130 dated Jun. 28, 2021.

* cited by examiner

ELECTRONIC SELF-DESTRUCTING FUSE STRUCTURE

TECHNICAL FIELD

The present invention relates to an electronic self-destructing fuse structure, and more particularly to an electronic self-destructing fuse structure configured to allow a safety device thereof to be released by a predetermined level of setback and centrifugal force after a 40 mm grenade is fired so as to secure safety, to allow the grenade to detonate when more than a predetermined level of impact is applied thereto, and to prevent the occurrence of undetonated grenades by causing the grenade to detonate after the lapse of a predetermined period of time during which impact does not reach the predetermined level and detonation thereof does not occur.

BACKGROUND ART

A 40 mm grenade is a type of military weapon that can kill people or destroy light armor and camps by being fired using a grenade launcher. Further, the 40 mm grenade was developed in the United States during the Vietnam War, and has been widely used in many countries in recognition of the great effectiveness thereof after being used in wars.

However, when fuse operation conditions are not met, a certain percentage of grenades remains undetonated. Undetonated grenades are disadvantageous not only because the effectiveness thereof in battled is reduced, but also because they are potentially harmful to fellow soldiers, civilians, and even the operator. Accordingly, appropriate handling of the undetonated grenades is significantly important.

That is, a grenade using a mechanical mechanism, in which a normally fired grenade senses a condition such as an impact and then detonates, has been widely used.

However, a detonation method of a mechanical fuse of the related art is not only structurally complicated, but also has a problem of low operational reliability, which results in a lot of undetonated grenades. Therefore, recently, efforts have been continuously made to solve the problem of the undetonated grenades by developing a fuse using an electronic self-destruction method using a reserve battery which is activated by striking the same.

Particularly, when a grenade falls on grass or in the mud and the impact applied thereto is weak, the same may not detonate. Further, generally, a safety device is required to be provided therein in order to prevent detonation thereof within a distance within which safety is required after the grenade is fired in order to protect a person using a grenade launcher and allies thereof. Accordingly, in consideration of two aspects, namely a function as a safety device and a function of self-destruction with reliable operation of the fuse, it is required to secure the safety and to smoothly implement the functions of detonation and self-destruction of the grenade.

DISCLOSURE

Technical Problem

Therefore, the present invention has been made in view of the above problems, and it is an object of the present invention to provide an electronic self-destructing fuse structure capable of preventing detonation of a fired grenade before the grenade moves a safe distance away and of allowing detonation thereof under predetermined conditions, thereby increasing the reliability of the grenade and preventing the occurrence of undetonated grenades.

Technical Solution

In accordance with the present invention, the above and other objects can be accomplished by the provision of an electronic self-destructing fuse structure including a lower plate structure including a first guide hole vertically penetrating therethrough and a first pin inserted into the first guide hole to vertically move, a substrate module disposed at a lower side of the lower plate structure, the substrate module including a first through-hole positioned corresponding to a position of the first pin, the first through-hole having a reserve battery mounted therein to be activated when struck by the first pin, a second through-hole including a first conductive wire formed thereacross and configured to detect a short circuit, a third through-hole including a second conductive wire formed thereacross and configured to detect a short circuit, and an electric detonator mounted at a lower side thereof, the electric detonator outputting, toward a lower side, an electrical detonation signal in response to the short circuit of the second conductive wire and detonating according to the electrical detonation signal, and a first safety structure disposed at a lower side of the substrate module, the first safety structure including a centrifugal force weight configured to be moved outwards from a center by centrifugal force and to short-circuit the first conductive wire, an impact weight configured to ascend and descend by inertia and to short-circuit the second conductive wire, and a first detonator hole formed to allow the electric detonator to be close to a spit-back.

Here, the lower plate structure may further include a second guide hole vertically penetrating therethrough, and a second pin inserted into the second guide hole to vertically move, the substrate module may further include a fourth through-hole configured to pass the second pin therethrough, and the first safety structure may further include a fixing member configured to temporarily fix the centrifugal force weight between the first safety structure and the substrate module and to be released by pressure from the second pin.

Further, the electronic self-destructing fuse structure may further include a second safety structure disposed at a lower side of the first safety structure, the second safety structure including a second detonator hole formed to transmit an explosive force of the electric detonator to the spit-back disposed at a lower side thereof, and an opening and closing unit configured to close the second detonator hole in an initial stage and to open the second detonator hole by centrifugal force.

In addition, the opening and closing unit may include a semi-circular rotor installed in a stacked form between the second detonator hole and the electric detonator and configured to control opening and closing of the second detonator hole, which is a passage through which a detonation pressure caused by detonation of the electric detonator is transmitted to the spit-back, which is booster powder, the rotor including a penetrating portion configured to open the second detonator hole when the rotor rotates by centrifugal force around a rotation shaft formed at an eccentric position away from the center of the grenade on the side of the second detonator hole, the first safety structure may further include a support protrusion configured to protrude toward a lower side of the centrifugal force weight and a fifth through-hole configured to allow the support protrusion to move downwards in a state of penetrating the first safety structure, and the support protrusion fixes the rotor to prevent a movement thereof and is moved in an outward direction by centrifugal force to cause rotation of the rotor.

Further, the rotor may include a gear formed along an outer peripheral surface with respect to the rotation shaft. A weight unit may be formed between the gear and the rotation shaft. The electronic self-destructing fuse structure may further include a conversion gear unit, disposed above the rotor and configured to rotate while being engaged with the gear of the rotor, the conversion gear unit reducing a rotation speed of the rotor, and a speed reduction unit configured to contact the conversion gear unit to reduce a rotation speed of the conversion gear unit.

In addition, the electronic self-destructing fuse structure may further include a cap-shaped upper plate structure configured to cover the lower plate structure from above and to be coupled thereto, the upper plate structure including a first accommodation groove and a second accommodation groove configured to accommodate upper ends of the first pin and the second pin, respectively.

Further, the substrate module may include a second conductive wire provided to extend along an outer rim thereof, and may be configured to have the same effect as a short circuit of the second conductive wire when the substrate module is damaged.

Further, the first conductive wire and the second conductive wire may have high conductivity, but may be thin conductive wires, the first conductive wire and the second conductive wire being formed by wire bonding or wedge bonding.

In addition, the first pin and the second pin may be placed on respective tang springs and mounted thereon.

In addition, the reserve battery may include an electrode formed on an upper portion thereof and configured to protrude from side to side, the electrode having a bottom surface that is electrically connected to the substrate module.

Further, the centrifugal force weight may include a fixing member configured to prevent movement of the centrifugal force weight in a fixed position, a short-circuit protrusion configured to cut the first conductive wire, a fixing protrusion configured to interrupt the impact weight, and a support protrusion configured to interrupt rotation of a rotor.

Advantageous Effects

As is apparent from the above description, an electronic self-destructing fuse structure of the present invention is capable of significantly reducing the rate of occurrence of undetonated grenades through a self-destruction function, thereby greatly reducing damage to allies and particularly to civilians.

Further, according to the present invention, after the grenade is fired, a safety device thereof is released by setback and centrifugal force, and the grenade operates in consideration of a speed change thereof after the safety device is released while ensuring the safety of a soldier operating a grenade launcher and fellow soldiers. Accordingly, the grenade may reliably detonate even upon a small impact in environments such as snow or mud, and may self-destruct through operation of an electronic circuit mounted on a substrate in the event of occurrence of an undetonated grenade, thereby securing the safety and increasing the efficiency of the grenade.

BEST MODE

Hereinafter, a self-destructing fuse structure according to the present invention will be described in detail with reference to the accompanying drawings.

Figure 1:
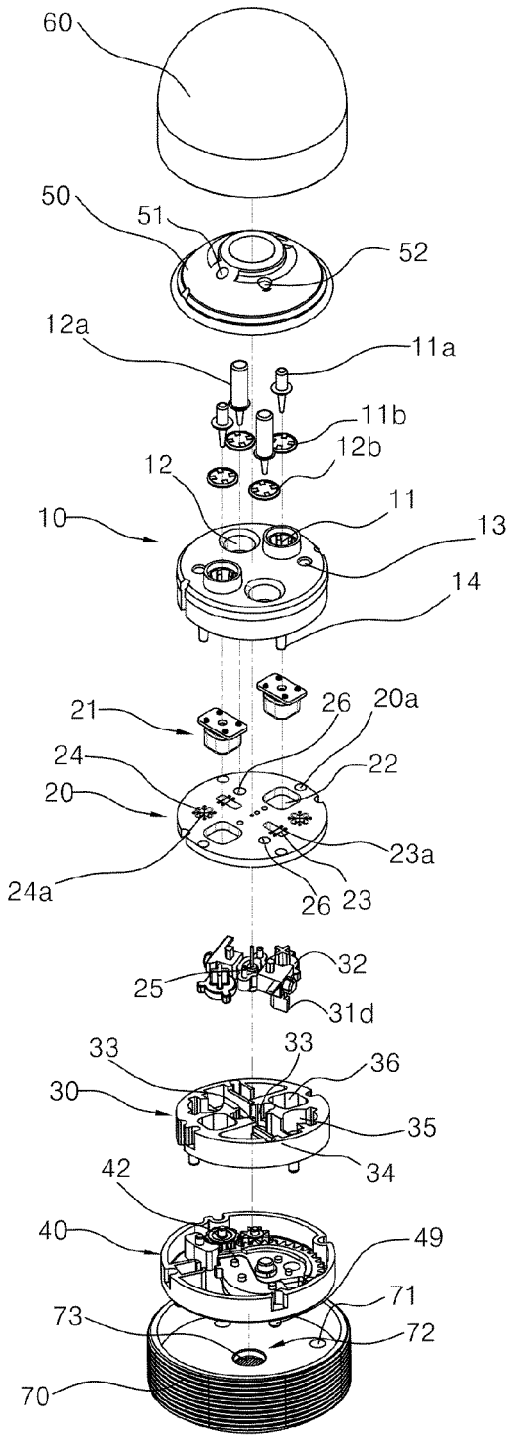
FIG. 1 is an exploded perspective view showing a disassembled state of a self-destructing fuse structure according to the present invention.
Figure 3:
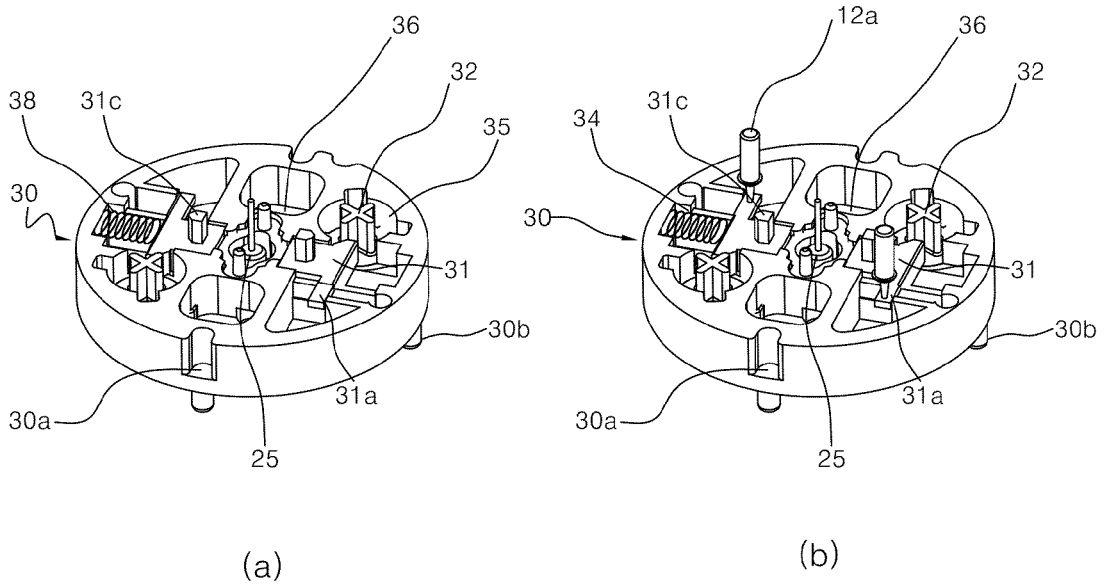
FIG. 3 is a perspective view showing the state in which a second pin strikes a connection portion between a fixing member and a centrifugal force weight.
Figure 4:
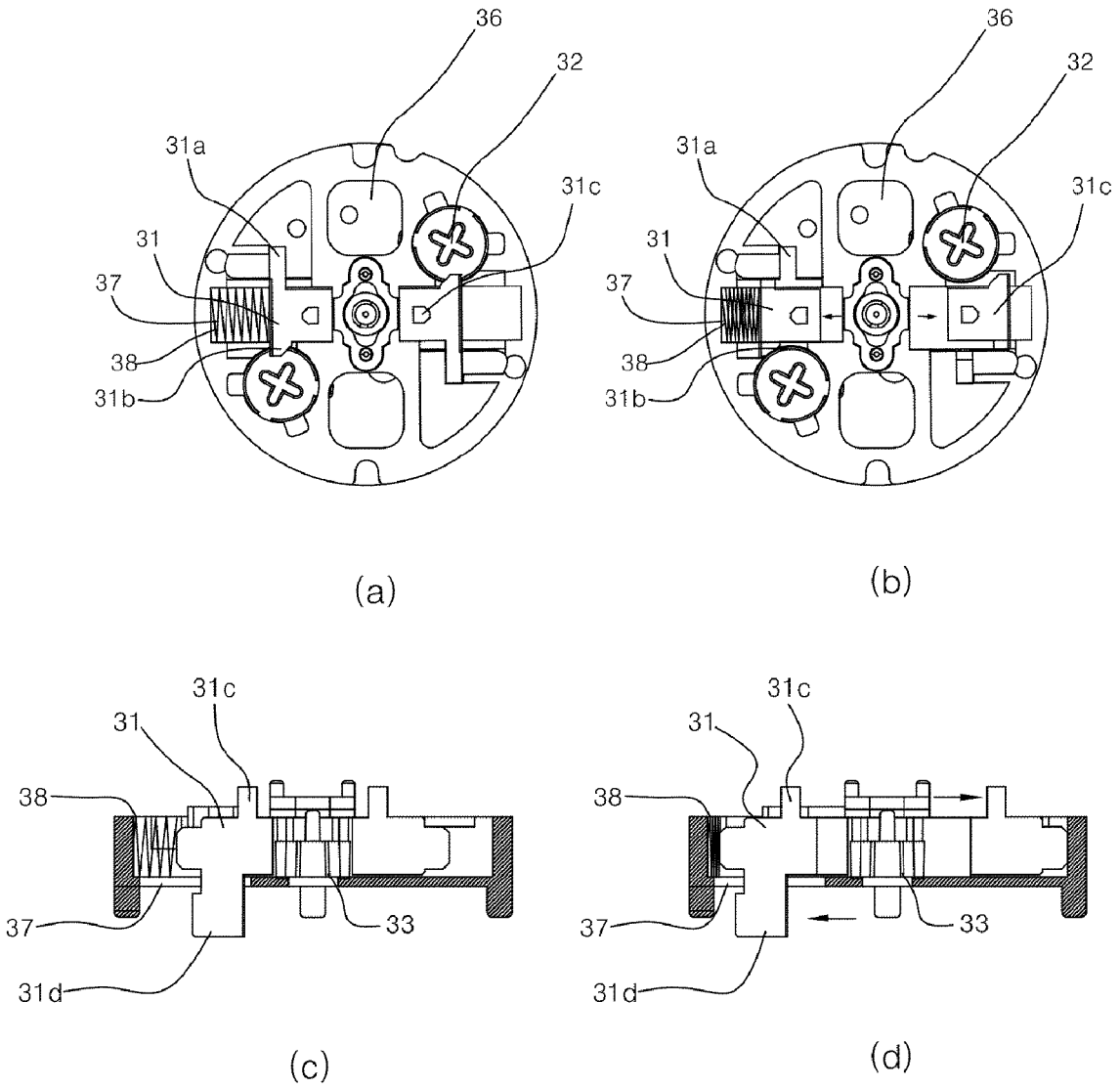
FIGS. 4A and 4B are top plan views showing the state in which the centrifugal force weight separated from the fixing member in the operation shown in FIG. 3 is pushed outwards by the rotational force of a grenade to release the interruption of an impact weight.
FIGS. 4C and 4D are cross-sectional views showing the state in which the centrifugal force weight separated from the fixing member in the operation shown in FIG. 3 is pushed outwards by the rotational force of the grenade to release the interruption of the impact weight.
Figure 5:
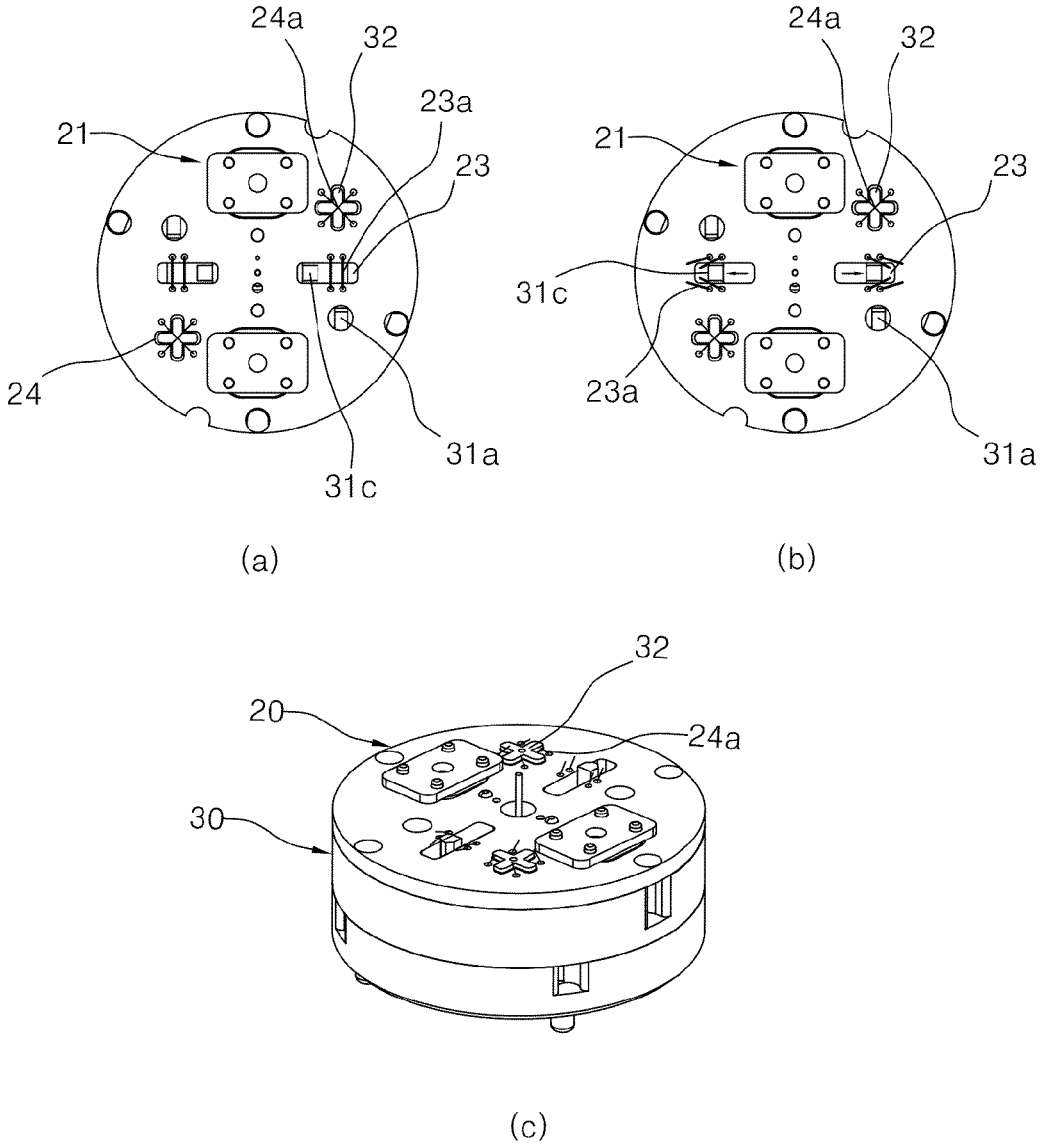
FIGS. 5A and 5B are views showing operational states in which the centrifugal force weight separated from the fixing member by the operation shown in FIG. 3 is pushed outwards by the rotational force of the grenade to short-circuit a first conductive wire.
FIG. 5C is a view showing an operational state in which the impact weight, the interruption of which is released by the operation shown in FIG. 4, moves forwards due to a speed change resulting from a grenade collision, thereby short-circuiting a second conductive wire.
Figure 6:
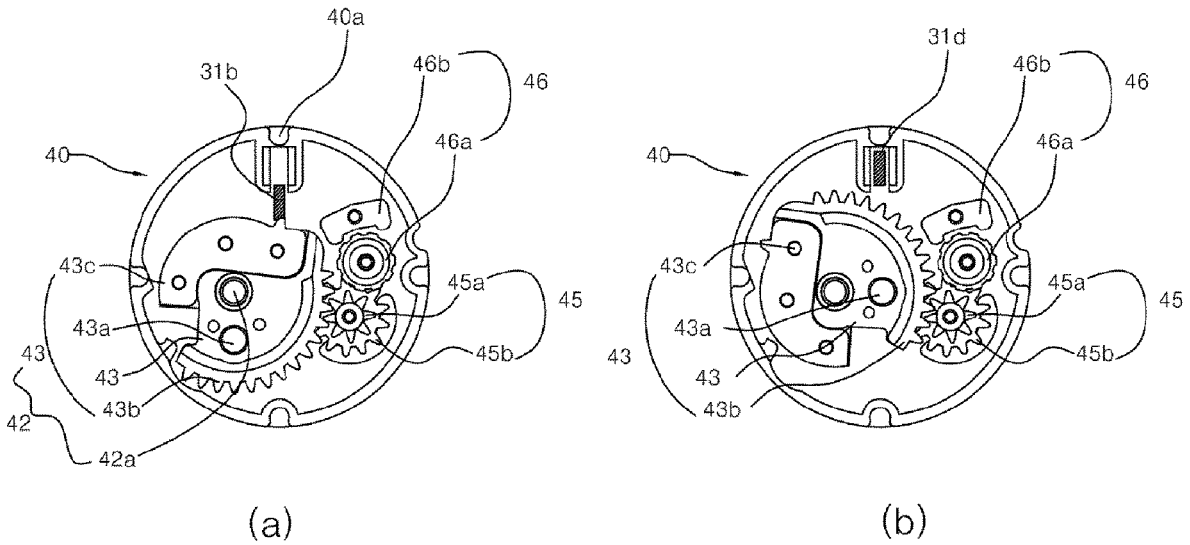
FIG. 6 is a top plan view showing an operational state of an opening and closing unit in which a protrusion formed under one of the two centrifugal force weights separated from the fixing member through the operation shown in FIG. 3 interrupts the rotation of a lower rotor and is pushed outwards by the rotational force of the grenade to release the interruption of the rotor, whereby, the self-destructing fuse structure according to the present invention becomes capable of rotation.

FIG. 1 is an exploded perspective view showing a disassembled state of the self-destructing fuse structure according to the present invention, FIG. 3 is a perspective view showing the state in which a second pin strikes a connection portion between a fixing member and a centrifugal force weight, FIGS. 4A and 4B are top plan views showing the state in which the centrifugal force weight separated from the fixing member through the operation shown in FIG. 3 is pushed outwards by the rotational force of the grenade to release interruption of an impact weight, and FIGS. 4C and 4D are cross-sectional views showing the state in which the centrifugal force weight separated from the fixing member through the operation shown in FIG. 3 is pushed outwards by the rotational force of the grenade to release the interruption of the impact weight. Further, FIG. 5 is a view showing the operational state in which the centrifugal force weight pushed outwards in the operation shown FIG. 4 short-circuits a first conductive wire, a protrusion that interrupts the impact weight releases the interruption of the impact weight, and, as a result, the released impact weight short-circuits a second conductive wire due to a speed change resulting from a grenade collision, FIG. 5A showing the state in which the first conductive wire is not short-circuited, FIG. 5B showing the state in which the centrifugal weight pushed outwards according to the operation shown in FIG. 4 short-circuits the first conductive wire, and FIG. 5C showing the state in which the released impact weight short-circuits the second conductive wire by the speed change due to the grenade collision. In addition, FIG. 6 is a top plan view showing an operational state of an opening and closing unit in which a protrusion formed under one of the two centrifugal force weights separated from the fixing member in the operation shown in FIG. 3 interrupts the rotation of a lower rotor and is pushed outwards by the rotational force of the grenade to release the interruption of the rotor, whereby, the self-destructing fuse structure according to the present invention becomes capable of rotation.

As shown in FIG. 1, the self-destructing fuse structure according to the present invention is largely formed of an upper plate structure 50, a lower plate structure 10, a substrate module 20, a first safety structure 30, and a second safety structure 40.

The upper plate structure 50 is a configuration of an upper portion of the lower plate structure 10, that is, of a warhead side, and includes a first accommodation groove 51 and a second accommodation groove 52 disposed at a location away from the first accommodation groove 51.

The first accommodation groove 51 and the second accommodation groove 52 include a first pin 11*a* and a second pin 12*a* accommodated therein to be described later, and serve to guide vertical movement of the first pin 11*a* and the second pin 12*a*. Here, in order to perform a stable coupling operation, two of each of the first pin 11*a* and the second pin 12*a* may be provided, that is, they may be provided in pairs. Accordingly, each of the first accommodation groove 51 and the second accommodation groove 52 may be provided in a pair formed symmetrically with respect to a central portion.

The lower plate structure 10 is configured to be coupled to a lower side of the upper plate structure 50, and a plurality of first coupling protrusions are formed on a lower surface of the upper plate structure 50 along a circumferential direction thereof. Accordingly, the lower plate structure 10 includes a first coupling groove 13 coupled to the first coupling protrusion 53 along the circumferential direction on an upper surface thereof to perform stable coupling therebetween at an accurate position.

The lower plate structure 10 includes a first guide hole 11 and a second guide hole 12 formed to correspond to respective positions of the first accommodation groove 51 and the second accommodation groove 52 in the upper plate structure 50 to which the lower plate structure 10 is coupled upwards, and, as such, the first pin 11*a* and the second pin 12*a* pass through the first guide hole 11 and the second hole 12, respectively, thereby achieving a structure movable upwards and downwards.

In this case, the first pin 11*a* is set to be placed over an upper end of the first guide hole 11, and the second pin 12*a* is set to be placed over an upper end of the second guide hole 12, respectively. A first tang spring 11*b*, which is an inertia spring, is provided in the middle of the first guide hole 11, and the first pin 11*a* is placed on the first tang spring 11*b*. In the same manner, a second tang spring 12*b*, which is an inertia spring, is provided in the middle of the second guide hole 12, and the second pin 12*a* is placed on the second tang spring 12*b*. In this manner described above, initial setting is performed.

The first tang spring 11*b* and the second tang spring 12*b* are configured to prevent any movement of the first pin 11*a* and the second pin 12*a*, respectively, along the first guide hole 11 and the second guide hole 12 due to a weak impact or an external force, and to have a function of allowing the first pin 11*a* and the second pin 12*a* to move downwards along the first guide hole 11 and the second guide hole 12, respectively, when a grenade is fired and force exceeding an amount specified by setback is applied thereto.

The substrate module 20 is a circuit board, which is represented as a PCB, coupled to a lower side of the lower plate structure 10. In order to perform stable coupling therebetween at an accurate position, the lower plate structure 10 includes a plurality of second coupling protrusions 14 formed on a lower side surface thereof along the circumferential direction thereof, and the substrate module 20 includes a plurality of second coupling grooves 20*a* formed in an upper surface thereof and coupled to the plurality of second coupling protrusions 14.

The substrate module 20 is formed of a first through-hole 22 corresponding to a position of the first pin 11*a*, the first through-hole 22 being provided to install a reserve battery 21 therein, a second through-hole 23 having a first conductive wire 23*a* formed thereacross, a third through-hole 24 including a second conductive wire 24*a* formed there across, and a fourth through-hole 26 having a size through which an end portion of the second pin 12*a* passes corresponding to a position of the second pin 12*a*.

The reserve battery 21 is a battery for power supply. In detail, the reserve battery 21 is normally in an inactive state in which power is not supplied thereto, and is activated upon application of an impact thereto from the upper first pin 11*a*, thereby supplying power thereto.

Here, the reserve battery 21 is not positioned on the upper side of the substrate module 20 but is positioned the first through-holes 22, whereby a sufficient stroke space between the reserve battery 21 and the first pin 11*a* may be secured, and the first pin 11*a* may accelerate while passing through the secured space, thereby more strongly striking the reserve battery 21.

Figure 2:
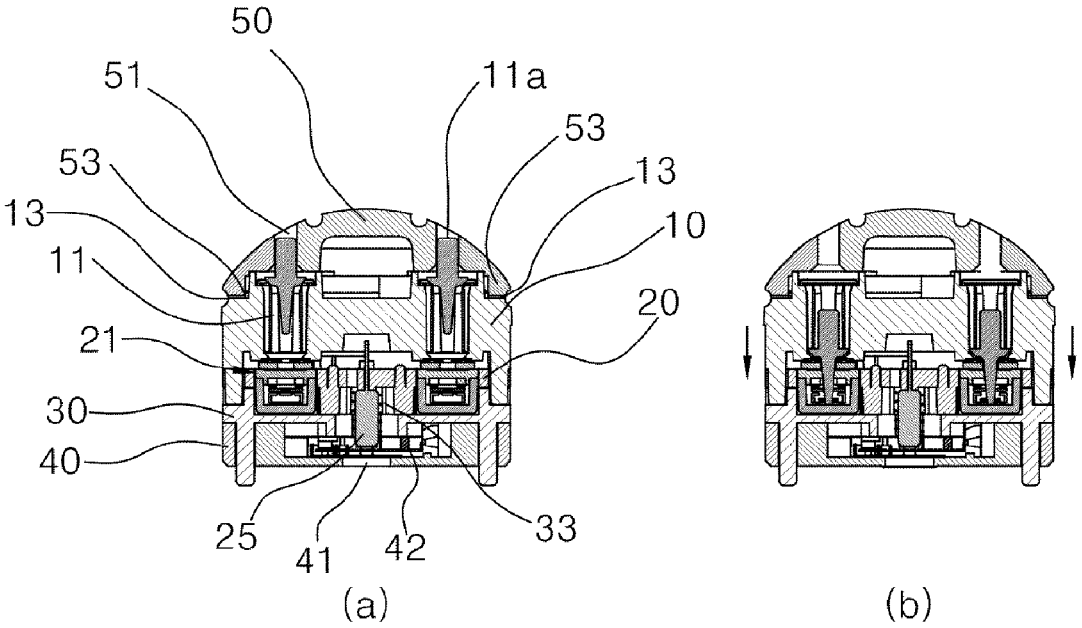
FIG. 2 is a cross-sectional view showing the state in which a first pin strikes a reserve battery.

FIG. 2 cross-sectional view showing the state in which the first pin 11*a* strikes the reserve battery 21.

The reserve battery 21 is a battery configured to be activated by an external strike applied thereto to generate electricity, and a bottom surface of an electrode protruding from side to side formed on an upper portion of the reserve battery 21 is electrically connected to the substrate module 20. Further, since the reserve battery 21 may be applied to various products as well as that of Patent Document KR 10-1445616 held by the present applicant, a detailed description of the reserve battery 21 will be omitted to prevent the gist of the present invention from being obscured.

As described above, since the first pin 11*a* and the second pin 12*a* are each symmetrically formed in pairs, the first through-hole 22, the second through-hole 23, the third through-hole 24, and the fourth through-hole 26 provided in the substrate module 20 are also each symmetrically formed in pairs.

An electric detonator 25 is installed at a lower side of the substrate module 20 to generate a detonation caused by an electrical signal received through a short circuit of the second conductive wire 24*a*.

The first safety structure 30 is configured to be installed at the lower side of the substrate module 20. In the same manner, in order to perform stable coupling therebetween at an accurate position, the second coupling protrusion 14 protruding downwards from the lower plate structure 10 is supported by the second coupling groove 20*a* formed in the substrate module 20, and protrudes further downwards from the second coupling groove 20*a* to be accommodated in and coupled into a third coupling groove 30*a* in the first safety structure 30.

The first safety structure 30 includes a centrifugal force weight 31 disposed therein corresponding to the position of the second through-hole 23, and an impact weight 32 disposed therein corresponding to the position of the third through-hole 24. In addition, the first safety structure 30 has a first detonator hole 33 formed in the center thereof so that the electric detonator 25 penetrates the same and approaches a spit-back 73 provided at a lower side of the first safety structure 30.

In order to dispose the centrifugal force weight and the impact weight 32 therein, the first safety structure 30 has a centrifugal force weight accommodation groove 34 and an impact weight accommodation groove 35 for the accommodation of the centrifugal force weight 31 and the impact weight 32. The centrifugal force weight accommodation groove 34 has a size to allow the centrifugal force weight 31 to be moved in a predetermined range by the centrifugal force from the center to the outside.

In addition, the first safety structure 30 further includes a reserve battery accommodation groove in which a lower portion of the reserve battery 21 mounted in the first through-hole 22 formed in the circuit board 20 is accommodated.

A fixing member 31*a*, which is configured to temporarily fix the centrifugal force weight in an initial stage to prevent movement thereof, is installed outside the centrifugal force weight 31. Further, a V-shaped groove is formed at a connection portion between the centrifugal force weight 31 and the fixing member 31*a* so that the connection portion therebetween may be relatively easily broken, and the fixing member 31*a* and the centrifugal force weight 31 may be separated from each other by the impact applied thereto by the second pin 12*a* moving through the fourth through-hole 26.

In addition, the centrifugal force weight 31 includes a fixing protrusion 31*b* to fix the impact weight 32 installed adjacent thereto at an initial position so that the same does not protrude upwards, and a short-circuit protrusion 31*c* formed at an upper portion thereof, the short-circuit protrusion 31*c* passing through the second through-hole 23 and protruding from the same to cut the first conductive wire 23*a*.

In this case, in order to perform a stable operation, two of each of the reserve battery 36, the centrifugal force weight 31, the impact weight 32, the second through-hole 23, and the third through-hole 24 are provided, that is, they are provided in pairs, and each pair thereof is formed to be symmetrical with respect to a central portion thereof. Further, a protrusion 31*d* formed at a lower end of one of the two centrifugal force weights 31, the one centrifugal force weight 31 being installed so that a spring 38 is compressed by the centrifugal force, interrupts rotation of a rotor 43 of the second safety structure 40, and releases the interruption of the rotor 43 mounted on the second safety structure 40 when pushed toward the circumference by rotation of the grenade. Further, when the rotor 43 moves and then the rotation of the grenade stops, the protrusion 31*d* also serves to prevent the rotor 43 from returning back to an initial position thereof due to a restoring force of the compressed spring 38.

The second safety structure 40 is coupled to a lower side of the first safety structure 30, a plurality of third coupling protrusions 30*b* are formed on a lower side surface of the first safety structure 30 along a circumference thereof, and a plurality of fourth coupling grooves 40*a* coupled thereto are formed in an upper side of the second safety structure 40, thereby providing a structure for stable coupling at an accurate position.

The spit-back 73 is positioned at a lower side of the second safety structure 40, and a second detonator hole 41 is formed in the second safety structure 40 so that the electric detonator 25 in the spit-back 73 is easily ignited. Particularly, as a safety device, an opening and closing unit 42 is provided to close the second detonator hole 41 in an initial stage and to open the second detonator hole 41 for detonation when detonation conditions are satisfied. In addition, the plurality of fourth coupling protrusions 49 are formed on the lower side surface of the second safety structure 40 along the circumference thereof so as to rotate together with the rotation of the grenade, and the fifth coupling groove 71 coupled thereto allows the second safety structure 40 to be coupled to the base plate 70 of the fuse unit of the grenade.

A spit-back accommodation groove 72 is formed in the base plate 70 positioned at the lower side of the second safety structure 40, the spit-back 73 is positioned in the spit-back accommodation groove 72, and the second detonator hole 41 is formed in the lower side of the second safety structure 40 so that the electric detonator 25 is close to the spit-back 73 to be reliably ignited. Particularly, as a safety device, the opening and closing unit 42 is provided to close the second detonator hole 41 in the initial stage and to open the second detonator hole 41 for detonation when the detonation conditions are satisfied.

The opening and closing unit 42 is configured to be opened by centrifugal force in consideration of the firing characteristics of the grenade. To this end, the rotor 43, having an area larger than that of the second detonator hole 41, is installed with respect to a rotation shaft 42*a* eccentric to a side surface of the second detonator hole 41 disposed in the center.

Here, a penetrating portion 43*a* capable of opening the second detonator hole 41 during the rotation of the rotor 43 is formed in the rotor 43, which is rotatable laterally around the rotation shaft 42*a*. That is, the rotor 43 blocks space between the second detonator hole 41 and the electric detonator 25 in an initial stage, and rotates by eccentric centrifugal force around the rotation shaft 42*a* during the rotation of the grenade so that the penetrating portion 43*a* is aligned with a position of the second detonator hole 41. Accordingly, the spit-back 73 is positionally aligned with the electric detonator 25 and mechanically armed so that the flame can be transmitted.

For this operation, the rotor 43 is formed so that an opening-and-closing side portion thereof having a large area with respect to the rotation shaft 42*a* covers the second detonator hole 41. Further, an outer peripheral surface of the opening-and-closing side portion of the rotor 43 has a circular arc formed therearound with respect to the first rotation shaft 42*a*, and the outer peripheral surface having the circular arc forms a gear 43*b* to be engaged with a first gear unit 45*a* to be described later. In addition, a relatively heavy weight unit 43*c* is formed on a rotation side portion opposite the penetrating portion 43*a* with respect to the rotational shaft 12*a*, thereby facilitating rotation of the rotor 43 by the centrifugal force.

The rotor 43 is a safety device configured to prevent the grenade from detonating within distance within which safety is required in an initial stage of grenade firing. Accordingly, the rotor 43 is initially fixed to block initial movement thereof, and mechanically armed after the grenade moves a safe distance away.

To this end, one of the centrifugal force weights of the first safety structure 30 is used, and the selected centrifugal force weight 31 includes a support protrusion 31*d*, the support protrusion 31*d* being formed at a lower side of the selected centrifugal force weight 31 and protruding downwards to a lower side of the first safety structure 30 to contact the rotor 43 and prevent rotation thereof. Correspondingly, a fifth through-hole 37 is formed in the first safety structure 30 so that the support protrusion 31*d* can move downwards in a state of penetrating the same.

That is, the support protrusion 31*d* maintains a fixed state so that the rotor 43 does not move when the centrifugal force weight 31 is in an initial position, and the centrifugal force weight 31 moves outwards by centrifugal force to be separated from the rotor 43 and to permit rotation of the rotor 43.

In this case, the rotor 43 includes a protrusion formed therein, the protrusion being in contact with the centrifugal force weight 31 at the initial position, and the spring 8 configured to push the centrifugal force weight 31 to the center may be formed on the outside of the centrifugal force weight 31, which serves to support the rotor 43.

Here, a speed adjustment unit 46 is installed on a side surface of the rotor 43 to prevent the rotor 43 from being quickly opened and closed and to prevent the grenade from being armed within a distance requiring safety, the speed adjustment unit 46 appropriately slowing down the rotation speed of the rotor 43. The speed adjustment unit 46 preferably includes a speed reduction unit configured to contact a conversion gear unit 45 to reduce the rotation speed of the conversion gear unit 45, the conversion gear unit 45 being disposed above the gear 43*b* of the rotor 43 and rotating while being engaged with the gear 43*b* of the rotor 43 to reduce the rotation speed of the rotor 43, the rotor 43 including the gear 43*b* formed on the outer peripheral surface thereof with respect to a rotation shaft of the rotor 43 and the weight unit 43*c* being formed on the opposite side of the gear 43*b*.

According to the description of the embodiment of the present invention, the spit-back 73 is positioned in the spit-back accommodation groove 72 in the base plate 70 located below the second safety structure 40, and the spit-back 73 is detonated by ignition of the upper electric detonator 25 when the second detonator hole 41 is open.

Figure 8:
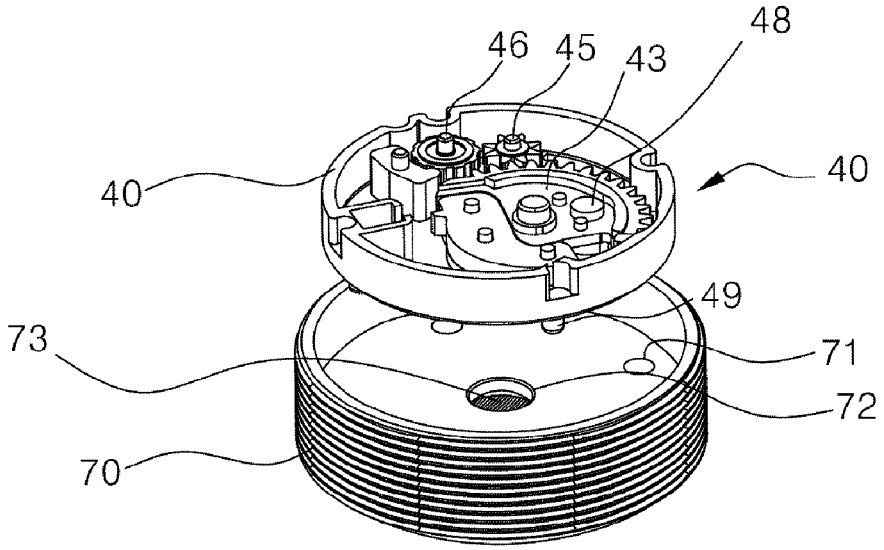
FIG. 8 is a view showing the state in which an opening and closing unit according to another embodiment of the present invention is combined with a base plate.

FIG. 8 is a view showing the state in which an opening and closing unit according to another embodiment of the present invention is combined with the base plate 70. A modification of the structure described above is made as follows. The penetrating portion 43*a*, which may communicate with the second detonator hole 41 in straight line when the rotor 43 is moved by centrifugal force, includes connection gunpowder 48 therein, the connecting gunpowder 48 being located between the electric detonator 25 and the spit-back 73. After that, the connection gunpowder 48 is detonated in a state of overlapping the electric detonator 25. Accordingly, a detonation pressure passes through the second detonator hole 41 and ignites the spit-back 73 installed below the second safety structure 40.

Next, an operation procedure of the self-destructing fuse structure including the above-described components is described as follows.

First, when the grenade is fired, as shown in FIG. 2, strong setback acting as firing propulsion of the grenade presses an action force of the first tang spring 11*b*, and the first pin 11*a*, supported by the first tang spring 11*b* is allowed to move. Next, the first pin 11*a* moves along the first guide hole 11 and strikes the reserve battery 21, whereby the reserve battery 21 is activated to generate electricity to supply power to the substrate module 20.

Further, as shown in FIGS. 3 and 4, in the same manner for the first pin 11*a*, when the grenade is fired, the setback is applied to the second tang spring 12*b*, and the second pin 12*a*, supported by the second tang spring 12*b*, is permitted to move. Next, the second pin 12*a* moves along the second guide hole 12, moves through the fourth through-hole 26, and strikes the centrifugal force weight 31 and the fixing member 31*a*, whereby the centrifugal force weight 31 is separated from the fixing member 31*a* and the same is allowed to move.

Next, as shown in FIG. 5, the centrifugal force weight 31 overcomes the action force of an externally mounted spring due to centrifugal force and presses the spring to be pushed outwards along the centrifugal force weight accommodation groove 34. Next, as the centrifugal force weight 31 moves outwards, the short-circuit protrusion 31*c* formed on the centrifugal force weight 31 short-circuits the first conductive wire 23*a*, thereby releasing a safety and preparing for detonation of the electric detonator 25.

In addition, when the fixing protrusion 31*b* formed on the opposite side of the fixing member 31*a* of the centrifugal force weight 31 releases the interruption of the impact weight 32, the impact weight 32 short-circuits the second conductive wire 24*a* to detonate the electric detonator 25 when an impact is applied to the grenade. In this case, the circuit is electronically controlled so that the grenade becomes armed after moving a safe distance away.

In addition, the operating principle of the opening and closing unit 42 provided in the second safety structure 40 is described as follows.

As shown in FIG. 6, when the centrifugal force weight 31 moves by the centrifugal force generated during the propulsion of the grenade, the support protrusion 31*d*, formed below the centrifugal force weight and on to prevent rotation of the rotor 43, moves along the fifth through-hole 37. Next, when the support protrusion 31*d* is separated from the rotor 43, the fixed state of the rotor 43 is released and the opening-and-closing side portion of the rotor 43, having a large area, rotates outwards by receiving centrifugal force around the rotation shaft 42*a*.

In this case, the gear 43*b* formed on the outer circumferential surface of the opening-and-closing side portion of the rotor 43 is engaged with the conversion gear unit 45 including the first gear unit 45*a* and the second gear unit 45*b* formed therein to reduce the rotation speed of the rotor 43, and the rotation speed of the rotor 43 is appropriately adjusted by the conversion gear unit 45 and the speed reduction unit, which is configured to reduce the rotation speed of the conversion gear unit 45 by contacting the same. In this state, the second detonator hole 41 is open so that the electric detonator 25 may detonate the spit-back 73 formed at the lower side, of the second safety structure 40.

In this manner, the speed adjustment unit reduces the speed at which the rotor 43 opens, thereby preventing the situation in which the second detonator hole 41 opens and the spit-back 73 is detonated while the grenade remains within a distance within which safety is required.

Further, when the grenade hits a target, the impact weight 32 passes through the third through-hole 24 due to inertia and protrudes upwards to cut and short-circuit the second conductive wire 24*a*, which is mounted in the third through-hole 24.

Here, when the current generated by the short circuit of the second conductive wire 24*a* is applied to the electric detonator 25 and the same is detonated, the spit-back 73 is ignited. After that, a booster in a grenade body catches fire, main gunpowder detonates, and the grenade detonates.

In addition, in order to prepare for the situation in which the impact weight 32 fails to cut the second conductive wire 24*a* even when an impact is applied to the grenade, it is preferable for the substrate module to include an additional electronic switch to cause the grenade to self-destruct after the lapse of a time set by a designer, thereby preventing subsequent death caused by the undetonated grenade.

As described above, basically, the electric detonator 25 may operate when the second conductive wire 24*a* is cut by the impact weight 32. However, depending on the impact angle of the grenade, damage to the lower plate structure 10 and the substrate module 20 and shape deformation thereof may be caused by the upper plate structure 50, and, as such, the impact weight 32 may not cut the second conductive wire 24*a*.

Figure 7:
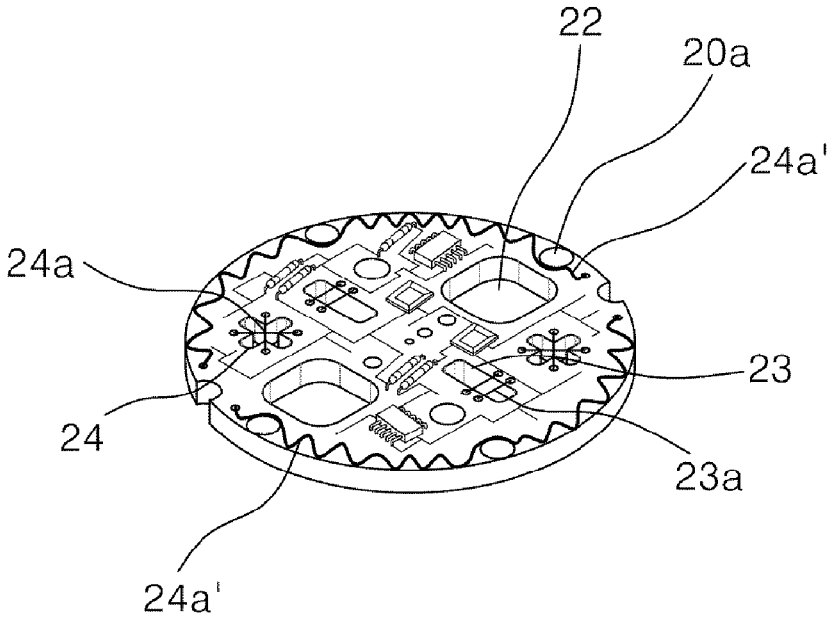
FIG. 7 is a perspective view showing the configuration of a substrate module according to another embodiment of the present invention.

FIG. 7 is a perspective view showing the configuration of a substrate module according to another embodiment of the present invention, and also showing the configuration in which the second conductive wire 24*a* is installed so as to extend outside the third through-hole 24 so as to immediately detect the above-mentioned damage to the substrate module 20.

That is, because a second conductive wire 24*a*' is provided along the outer rim of the substrate module 20, the second conductive wire 24*a*' is cut when damage to a substrate occurs at various impact angles and the electric detonator 25 is operated, thereby preventing the grenade from remaining undetonated due to damage to the grenade.

The invention claimed is:

1. An electronic self-destructing fuse structure comprising:

a lower plate structure comprising a first guide hole vertically penetrating therethrough and a first pin inserted into the first guide hole to vertically move;

a substrate module disposed at a lower side of the lower plate structure, the substrate module comprising a first through-hole positioned corresponding to a position of the first pin, the first through-hole having a reserve battery mounted therein to be activated when struck by the first pin, a second through-hole comprising a first conductive wire formed thereacross and configured to detect a short circuit, a third through-hole comprising a second conductive wire formed thereacross and configured to detect a short circuit, and an electric detonator mounted at a lower side of the substrate module, the electric detonator outputting an electrical detonation signal in response to the short circuit of the second conductive wire and being detonated according to the electrical detonation signal; and a first safety structure disposed at a lower side of the substrate module, the first safety structure comprising a centrifugal force weight configured to be moved outwards from a center by centrifugal force and to short-circuit the first conductive wire, an impact weight configured to ascend by inertia and to short-circuit the second conductive wire, and a first detonator hole formed to allow the electric detonator to be close to a spit-back.

2. The electronic self-destructing fuse structure according to claim 1, wherein:

the lower plate structure further comprises a second guide hole vertically penetrating therethrough and a second pin inserted into the second guide hole to vertically move, the substrate module further comprises a fourth through-hole configured to pass the second pin therethrough, and the first safety structure further comprises a fixing member configured to temporarily fix the centrifugal force weight and to be released by pressure from the second pin by setback generated when a grenade is fired.

3. The electronic self-destructing fuse structure according to claim 2, further comprising a cap-shaped upper plate structure configured to cover the lower plate structure and the lower plate structure being coupled to the cap-shaped upper plate structure, the upper plate structure comprising a first accommodation groove and a second accommodation groove configured to accommodate upper ends of the first pin and the second pin, respectively.

4. The electronic self-destructing fuse structure according to claim 1, further comprising a second safety structure disposed at a lower side of the first safety structure, the second safety structure comprising a second detonator hole formed to transmit an explosive force of the electric detonator to the spit-back disposed at a lower side thereof, and an opening and closing unit configured to close the second detonator hole in an initial stage and to open the second detonator hole by centrifugal force.

5. The electronic self-destructing fuse structure according to claim 4, wherein:

the opening and closing unit comprises a rotor configured to block a space between the second detonator hole and the electric detonator, the rotor comprising a penetrating portion configured to open the second detonator hole when the rotor is moved in a circumferential direction of a grenade by centrifugal force around a rotation shaft formed on a side surface of the second detonator hole, the first safety structure further comprises a support protrusion configured to protrude toward a lower side of the centrifugal force weight, and a fifth through-hole configured to allow the support protrusion to move downwards in a state of penetrating the first safety structure, and the support protrusion fixes the rotor to prevent movement thereof and is moved in an outward direction by centrifugal force to permit rotation of the rotor.

6. The electronic self-destructing fuse structure according to claim 5, wherein the rotor comprises a gear formed along an outer peripheral surface of an opening-and-closing side portion thereof with respect to the rotation shaft, the opening-and-closing side portion controlling opening and closing of the second detonator hole, and a weight unit formed on a rotation side portion disposed in an opposite direction of the opening-and-closing side portion thereof, further comprising:

a conversion gear unit comprising a first gear unit, disposed at an upper portion thereof, configured to rotate while being engaged with the gear of the rotor, and a second gear unit, disposed at a lower portion thereof, having a relatively large gear ratio, and a speed adjustment unit configured to contact the conversion gear unit to reduce a rotation speed of the conversion gear unit through rotation resistance.

7. The electronic self-destructing fuse structure according to claim 5, wherein connection gunpowder is placed on the penetrating portion formed in the rotor to accelerate ignition of the spit-back.

8. The electronic self-destructing fuse structure according to claim 1, wherein the substrate module comprises the second conductive wire provided to extend along an outer rim thereof, and is configured to have a same effect as a short circuit of the second conductive wire when the substrate module is damaged.

9. The electronic self-destructing fuse structure according to claim 1, wherein the first conductive wire and the second conductive wire have conductivity, the first conductive wire and the second conductive wire being formed by wire bonding or wedge bonding.

10. The electronic self-destructing fuse structure according to claim 1, wherein the first pin and the second pin are placed and mounted on respective tang springs.

11. The electronic self-destructing fuse structure according to claim 1, wherein the reserve battery comprises an electrode formed on an upper portion thereof and configured to protrude from side to side, the electrode having a bottom surface electrically connected to the substrate module.

12. The electronic self-destructing fuse structure according to claim 1, wherein the centrifugal force weight comprises:

a fixing member configured to prevent movement of the centrifugal force weight in a fixed position, a short-circuit protrusion configured to cut the first conductive wire, a fixing protrusion configured to interrupt the impact weight, and a support protrusion configured to interrupt rotation of a rotor.

* * * * *